United States Patent [19]

Eylon et al.

[11] Patent Number: 4,917,858

[45] Date of Patent: Apr. 17, 1990

[54] METHOD FOR PRODUCING TITANIUM ALUMINIDE FOIL

[75] Inventors: Daniel Eylon, Dayton; Francis H. Froes, Xenia, both of Ohio

[73] Assignee: The United States of America as represented by the Secretary of the Air Force, Washington, D.C.

[21] Appl. No.: 387,925

[22] Filed: Aug. 1, 1989

[51] Int. Cl.[4] ..... B22F 3/24

[52] U.S. Cl. ..... 419/28; 75/245; 419/29; 419/43; 419/46

[58] Field of Search ..... 419/28, 29, 43, 46; 75/245

[56] References Cited

U.S. PATENT DOCUMENTS

| | | | |
|---|---|---|---|
| 3,122,434 | 2/1964 | Reed et al. | 75/214 |
| 3,330,654 | 7/1967 | Sweet | 75/208 |
| 3,496,036 | 2/1970 | Di Giambattista | 148/126 |
| 3,685,134 | 8/1972 | Blue | 29/420.5 |
| 3,729,971 | 5/1973 | Gurganus et al. | 72/226 |
| 3,796,563 | 3/1974 | Wieland, Jr. et al. | 75/200 |
| 4,534,935 | 8/1985 | Ambrose et al. | 419/23 |
| 4,594,217 | 6/1986 | Samal | 419/3 |
| 4,617,054 | 10/1986 | Mathers | 75/246 |
| 4,624,705 | 11/1986 | Jatkar et al. | 75/239 |
| 4,659,546 | 4/1987 | Kearns | 419/2 |
| 4,849,163 | 7/1989 | Bellis et al. | 419/3 |

OTHER PUBLICATIONS

"Status of Titanium Powder Metallurgy," Eylon et al., in Industrial Applications of Titanium and Zirconium, ASTMSTP 830, pp. 48–65.

"Property Improvement of Low Chlorine Ti Alloy Blended Elemental Powder Compacts by Microstructure Modification," Eylon et al., Progress in Powder Metallurgys, V42, pp. 625–634, (1986).

*Primary Examiner*—Stephen J. Lechert, Jr.
*Assistant Examiner*—Leon Nigohosian, Jr.
*Attorney, Agent, or Firm*—Bobby D. Scearce; Donald J. Singer

[57] ABSTRACT

A method for producing foil of titanium aluminide is described which comprises providing a preselected quantity of blended powder of chloride free commercially pure elemental titanium, aluminum and other alloying metal(s) in preselected proportions, rolling the blended powder into a green foil, sintering the green foil, and thereafter pressing the sintered foil to full density.

11 Claims, No Drawings

METHOD FOR PRODUCING TITANIUM ALUMINIDE FOIL

RIGHTS OF THE GOVERNMENT

The invention described herein may be manufactured and used by or for the Government of the United States for all governmental purposes without the payment of any royalty.

BACKGROUND OF THE INVENTION

The present invention relates generally to methods for processing titanium alloys in the fabrication of powder metallurgy (PM) titanium alloy articles and more particularly to a method for producing substantially full density titanium aluminide foil.

Titanium aluminide based matrix composites have potential significant high temperature applications in the temperature range to about 1500° F. for $Ti_3Al$ (alpha-2) based composites and to about 1800° F. for TiAl (gamma) based composites mainly because of their characteristic low density, high temperature strength and modulus, and oxidation resistance. Conventional methods for producing titanium alloy foil which include vacuum annealed cold rolling to a desired thin gauge in successive cycles generally cannot successfully be used for titanium aluminides because of the very low ductility (brittleness) at room temperature which characterize the alloys. Consequently, titanium aluminide foil was produced heretofore by hot rolling between mild steel plates (pack rolling) which is expensive and produces a product having poor surface quality, or by chemical milling of thick plate to a foil which is expensive and wasteful.

Background information on production of titanium alloy foils is presented in "Status of Titanium Powder Metallurgy," by Eylon et al, *Industrial Applications of Titanium and Zirconium: Third Conference,* ASTM STP 830, pp 48–65 (1984), but the foils Produced by the methods described are not fully dense as a result of a high level of chlorides in the elemental titanium powder, and therefore have inferior mechanical properties, particularly fatigue behavior. In "Property Improvement of Low Chlorine Titanium Alloy Blended Elemental Powder Compacts by Microstructure Modification," by Eylon et al. ("Progress in Powder Metallurgy", Vol 42, pp 625–634 (1986), Proc MPIF Annual Powder Metallurgy Conference and Exhibition, May 18–21, Boston Mass. it was demonstrated that 100% density can be achieved in conventional PM compacted articles if extra low chlorine (less than 10 ppm) powder is used and if the sintered product is re-pressed, such as by hot isostatic pressing (HIP). Teachings of these references and background material presented therein are incorporated herein by reference.

The invention substantially solves or reduces in critical importance problems with previously existing methods by providing a relatively low cost method for reliably producing quality full density titanium aluminide foils of particular utility in fabricating titanium aluminide based metal matrix composite articles. According to the invention, blended irregularly shaped powder of chlorine free commercially pure (CP) elemental titanium, aluminum and other alloying metal(s) in preselected proportions are rolled into a green foil and vacuum sintered, and thereafter densified to full density by pressing such as by vacuum hot pressing (VHP), hot isostatic pressing (HIP), or additional hot rolling. Thin foils of substantially 100% density may be produced according to the invention.

It is therefore a principal object of the invention to provide a method for producing full density foils of titanium aluminide.

It is a further object of the invention to provide a method for producing full density foils of titanium aluminide in the fabrication of titanium aluminide based composites.

These and other objects of the invention will become apparent as the detailed description of representative embodiments proceeds.

SUMMARY OF THE INVENTION

In accordance with the foregoing principles and objects of the invention, a method for producing foil of titanium aluminide is described which comprises providing a preselected quantity of blended powder of chloride free commercially pure (CP) elemental titanium, aluminum and other alloying metal(s) in preselected proportions, rolling the blended powder into a green foil, sintering the green foil, and thereafter vacuum pressing the sintered foil to full density.

DETAILED DESCRIPTION

According to the teachings of the invention herein a selected quantity of (preferably irregularly shaped) powder of chloride free CP elemental titanium and aluminum in preselected proportions to produce an alloy of the desired composition is blended and cold or hot rolled at about room temperature to 700° C. to form a green foil substantially as described in the above-referenced paper by Eylon et al entitled "Status of Titanium Powder Metallurgy" the teachings of which paper and pertinent references therein are incorporated herein by reference. The chlorine free powders may be produced by substantially any conventional process within the contemplation of the invention, such as the hydride-dehydride (HDH) method. The as rolled green foil may be in the form of a sheet having thickness of about 0.1 to 10 millimeters. At the rolling temperature, the unalloyed titanium and aluminum powders are very ductile and can be easily rolled. The material may develop brittle alpha-2 or gamma phases but only during sintering.

It is noted that the method described herein may be applied to production of foils of alloys comprising either $Ti_3Al$ or TiAl. Further, the foils may comprise alloys including one or more additional alloying constituents, such as niobium, molybdenum, vanadium, chromium, manganese, erbium or yttrium, as would occur to the skilled artisan guided by these teachings to form foils of alloys including, but not limited to, (in at %) Ti-24Al-11Nb, Ti-48Al-1Nb, Ti-25Al-10Nb-3V-1Mo, Ti-48Al-1Nb-1Cr-1Mn, Ti-48Al-1Cr-1Mo, and Ti-48Al, in addition to substantially pure $Ti_3Al$ or TiAl foils. Accordingly, the starting blend of powder will include appropriate proportions of titanium and aluminum and/or a master alloy powder of aluminum and one or more additional alloying elements to form the desired titanium aluminide, viz., $Ti_3Al$ or TiAl, and one or more additional alloying elements in chlorine free powder form.

The green foil is then sintered at about 500° to 1200° C. for alloys comprising $Ti_3Al$ and at about 500° to 1300° C. for alloys comprising TiAl in order to consolidate the green foil into the desired alloy product form, to homogenize the chemistry and form the correct alloy composition to bond the powder particles into a near full density product (density of 88–98% theoretical density), and to remove to the extent practicable any gaseous constituents present by reason of the green foil formation step. After sintering, the sintered foil may be cut to strips of substantially any selected size for post sinter densification. The sintered strips are then removed to a press for densification to substantially 100% theoretical density utilizing VHP, HIP, hot rolling, hot die forging, or other suitable pressing technique. The foils may be densified at about 800° to 1200° C. for $Ti_3Al$ containing alloys, and at about 900° to 1300° C. for TiAl containing alloys. at about 5 to 120 ksi. The alloy foil product may ordinarily be about 0.1 to 10 millimeters thick.

It is noted that the final densification step as just described may be performed in combination with a hot pressing step (e.g. VHP) in the consolidation of a composite comprising the sintered foil as matrix, since in the hot pressing step in the formation of the composite, the pressure used may be high enough to result in substantially 100% density of the matrix in the composite.

The invention therefore provides a method for producing substantially 100% dense low cost foils comprising titanium alpha-2 or gamma aluminides having improved surface quality important to subsequent bonding thereof as a matrix in a composite product. It is understood that modifications to the invention may be made as might occur to one skilled in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. A method for producing a titanium aluminide alloy foil comprising the steps of:

(a) providing a preselected quantity of blended elemental powder including substantially chloride free unalloyed titanium and aluminum in preselected proportions;

(b) rolling said powder to predetermined thickness to form a foil of a titanium-aluminum alloy in said preselected proportions of elemental powder;

(c) sintering said foil; and (d) hot pressing said foil to densify said foil to substantially 100% theoretical density of said alloy.

2. The method of claim 1 wherein said blended elemental powder further comprises an alloying element selected from the group consisting of niobium, molybdenum, vanadium, chromium, manganese, erbium and yttrium.

3. The method of claim 1 wherein said preselected proportions are selected to form $Ti_3Al$ in said alloy.

4. The method of claim 1 wherein said preselected proportions are selected to form TiAl in said alloy.

5. The method of claim 3 wherein said rolling step is performed at about room temperature to 700° C.

6. The method of claim 4 wherein said rolling step is performed at about room temperature to 700° C.

7. The method of claim 3 wherein said sintering step is performed at about 500° to 1200° C.

8. The method of claim 4 wherein said sintering step is performed at about 500° to 1300° C.

9. The method of claim 3 wherein said hot pressing step is performed at about 1100° C.

10. The method of claim 4 wherein said hot pressing step is performed at about 1150° C.

11. The method of claim 1 wherein said hot pressing step is performed at about 5 to 120 ksi.

* * * * *

UNITED STATES PATENT AND TRADEMARK OFFICE

CERTIFICATE OF CORRECTION

PATENT NO. : 4,917,858

DATED : April 17, 1990

INVENTOR(S) : Daniel Eylon et al

It is certified that error appears in the above-identified patent and that said Letters Patent is hereby corrected as shown below:

Col 1, line 36, after "foils", the following should be inserted: ---by rolling and sintering a green foil of blended elemental powders---.

Signed and Sealed this

Fifth Day of November, 1991

*Attest:*

HARRY F. MANBECK, JR.

*Attesting Officer*

*Commissioner of Patents and Trademarks*